US005977716A

United States Patent [19]

Motouchi

[11] Patent Number: 5,977,716

[45] Date of Patent: Nov. 2, 1999

[54] ION GENERATOR FOR A COMBUSTION DEVICE

[76] Inventor: Kazuo Motouchi, D-102, 4-204-1, Minamibefu, Nishi-ku, Kobe-shi, Hyogo 651-21, Japan

[21] Appl. No.: 08/894,734

[22] PCT Filed: Dec. 26, 1996

[86] PCT No.: PCT/JP96/03896

§ 371 Date: Aug. 27, 1997

§ 102(e) Date: Aug. 27, 1997

[87] PCT Pub. No.: WO97/24523

PCT Pub. Date: Jul. 10, 1997

[30] Foreign Application Priority Data

Dec. 28, 1995 [JP] Japan ..... 7-352967

[51] Int. Cl.[6] ..... H01J 27/02

[52] U.S. Cl. ..... 315/111.91; 250/423 F; 123/537

[58] Field of Search ..... 315/111.21, 111.31, 315/111.81, 111.91; 250/423 R, 423 F, 426; 1232/563, 537, 539

[56] References Cited

U.S. PATENT DOCUMENTS 4,308,844 1/1982 Persinger ..... 123/537 X

FOREIGN PATENT DOCUMENTS 0 212 379 3/1987 European Pat. Off. .

24 35 481 2/1976 Germany .

56-162257 12/1981 Japan .

58-93952 3/1983 Japan .

58-53139 6/1983 Japan .

63-192950 8/1988 Japan .

01 232 156 9/1989 Japan .

OTHER PUBLICATIONS

Microfilm of the specification and drawings annexed to the written application of Japanese Utility Model Application No. 188348/1980 (Laid–open No. 109836/1982), Jul. 7, 1982.

*Primary Examiner*—Justin P. Bettendorf

*Attorney, Agent, or Firm*—Armstrong, Westerman, Hattori, McLeland & Naughton

[57] ABSTRACT

An ion generator used for supplying an ionized air to an intake section of a combustion apparatus such as combustion engines and the like. In an air-flow passage within a casing, a high-voltage generator is disposed on the upstream side whereas an ionization electrode is disposed on the downstream side. A gap for the air-flow passage is defined between the high-voltage generator and the casing so as to allow for the air-cooling of the high-voltage generator. The ionization electrode has its outside electrode set to the negative pole and its inside electrode set to the positive pole so as to prevent the occurrence of plasma discharge in a space pace other than that between the both electrodes. This is effective to prevent the high-voltage generator from being overheated, thus contributing to an increased service life thereof.

6 Claims, 7 Drawing Sheets

ION GENERATOR FOR A COMBUSTION DEVICE

BACKGROUND OF THE INVENTION

The present invention relates to an ion generator for use in a combustion apparatus, such as internal combustion engines and the like, the generator adapted to ionize air introduced into a casing for supplying the ionized air to an air intake section of the combustion apparatus.

Heretofore, ion generators have been provided in the art for supplying ionized air to intake manifolds of internal combustion engines so as to enhance the combustion efficiency of the internal combustion engines as the combustion apparatus with the aim of improving the fuel economy and reducing the air pollution. Such an ion generator has been disclosed by, for example, Japanese Examined Utility Model Publication No.3(1991)-39192.

The ion generator disclosed in this publication comprises, as shown in FIG. 12, a casing 91 including an intake port 92 formed in one end surface thereof, an exhaust port 93 formed in the opposite end surface thereof, an air-flow passage extending between the air intake port 92 and the exhaust port 93, and an ionization electrode 94 disposed in the air-flow passage. The ionization electrode 94 is comprised of a cylindrical outside electrode 94*a* surrounding the air-flow passage and an inside electrode 94*b* disposed inside of the outside electrode 94*a* and composed of a plurality of star-shaped electrodes. The air flowing through the air-flow passage is ionized by plasma discharge between the outside electrode 94*a* and the inside electrode 94*b*. The air thus ionized is supplied to an intake manifold of the internal combustion engine via the exhaust port 93.

The casing 91 further contains therein a high-voltage generator 95 for supplying a high voltage to the ionization electrode 94. The high-voltage generator 95 is formed by first placing its components in the casing 91 and then molding the components with an insulating resin material. The high-voltage generator 95 has its positive pole connected to the outside electrode 94*a* of the ionization electrode 94 and its negative pole connected to the inside electrode 94*b*, respectively.

The ionization electrode 94 is accommodated in a vessel 96 formed of an insulating resin material, thus insulated from the casing 91, which is comprised of an aluminum die-cast product.

Unfortunately, however, the ion generator of the above construction has suffered a short service life of the high-voltage generator 95 for supplying the high voltage to the ionization electrode 94 to effect plasma discharge. Intensive studies have clarified the cause of such a reduced service life of the high-voltage generator. That is, the outside electrode 94*a* of the ionization electrode 94 is set to the positive pole while the casing 91 is mounted to the vehicle body as grounded. Therefore, additionally to the plasma discharge between the outside electrode 94*a* and the inside electrode 94*b*, there occurs another plasma discharge between the outside electrode 94*a* and the casing 91, so that heat resulted from the former plasma discharge combines with heat resulted from the latter to overheat the high-voltage generator 95.

OBJECT AND SUMMARY OF THE INVENTION

The present invention is based on this founding and has an object to provide an ion generator for use in the combustion apparatuses adapted to achieve a long service life of the high-voltage generator.

An ion generator according to the invention for achieving the above object comprises:

a cylindrical casing including an intake port at one end surface thereof, an exhaust port at the other end surface thereof and an air-flow passage defined between the intake port and the exhaust port, and grounded to a predetermined portion, a high-voltage generator disposed on the upstream side of the air-flow passage as defining a gap for the air-flow passage between the inner periphery of the casing and the high-voltage generator itself, and an ionization electrode disposed on the downstream side of the air-flow passage and having an outside electrode and an inside electrode spaced from each other by a predetermined distance, the inside electrode connected to the positive pole of the high-voltage generator while the outside electrode connected to the negative pole thereof.

According to the ion generator of the above construction, since the outside electrode of the ionization electrode is connected to the negative pole of the high-voltage generator, the outside electrode has the same polarity with that of the casing which is grounded. This is effective to prevent the occurrence of plasma discharge in a space other than that between the outside electrode and the inside electrode. Additionally, the air drawn into the casing via the intake port is allowed to flow through the gap defined between the high-voltage generator and the casing for cooling the high-voltage generator. Furthermore, the high-voltage generator is located upstream of the ionization electrode in the air-flow passage and hence, the high-voltage generator is prevented from being affected by the heat generated by the ionization electrode. Thus, the high-voltage generator is prevented from being overheated, thus achieving a longer service life than that of the prior-art high-voltage generator.

In a preferred mode hereof, the ion generator for use in the combustion apparatuses is characterized in that the inside electrode of the ionization electrode comprises a brush-type electrode including a multitude of bristles, such as of a conductive metal, extending radially toward the inner periphery of the cylindrical outside electrode.

According to this mode, the plasma discharge between the outside electrode and the inside electrode is effected in a stable and efficient manner thereby efficiently ionizing the air drawn into the casing. This contributes to an increased combustion efficiency of the combustion apparatus, resulting in effective improvement of the fuel economy and reduction of the air pollution. In such a mode, the aforesaid brush-type electrode is preferably in the form of a bar wherein the bristles are successively arranged for a predetermined length along the axis of the inside electrode. According to the mode, the aforesaid plasma discharge is effected in a more stable and efficient manner thereby even more efficiently ionizing the air drawn into the casing. As a result, the combustion apparatus achieves an even greater combustion efficiency for more enhanced improvement of the fuel economy and reduction of the air pollution.

The outside electrode may comprise a brush-type electrode wherein a multitude of bristles, such as of a conductive metal, extend toward a bar-like inside electrode as surrounding the inside electrode. This mode is also adapted to effect the plasma discharge between the outside electrode and the inside electrode in a stable and efficient manner for an efficient ionization of the air drawn into the casing. It is preferred in the mode that the aforesaid brush-type electrode is in the form of a cylinder wherein the bristles are successively arranged for a predetermined length axially of the outside electrode. Such a mode is also adapted to effect the aforesaid plasma discharge in a more stable and efficient manner for a more efficient ionization of the air drawn into the casing.

In another preferred mode hereof, the ion generator comprises the outside electrode formed of a flat plate, and the inside electrode formed of an array of sharp-pointed members oriented toward the outside electrode. The mode is also adapted to effect the aforesaid plasma discharge in a more stable and efficient manner for a more efficient ionization of the air drawn into the casing.

Preferably, the outside electrode of the ionization electrode comprises a part of the casing. This mode contributes to a reduced number of components and size of the ion generator.

It is preferred that the intake port, the exhaust port and the high-voltage generator are concentrically arranged about the axis of the casing. Such a mode provides uniform air-cooling of the high-voltage generator, thus increasing the service life thereof even further.

DETAILED DESCRIPTION OF THE PREFERRED EMBODIMENT

Now, preferred embodiments of the invention will hereinbelow be described in detail with reference to the accompanying drawings.

Figure 1:
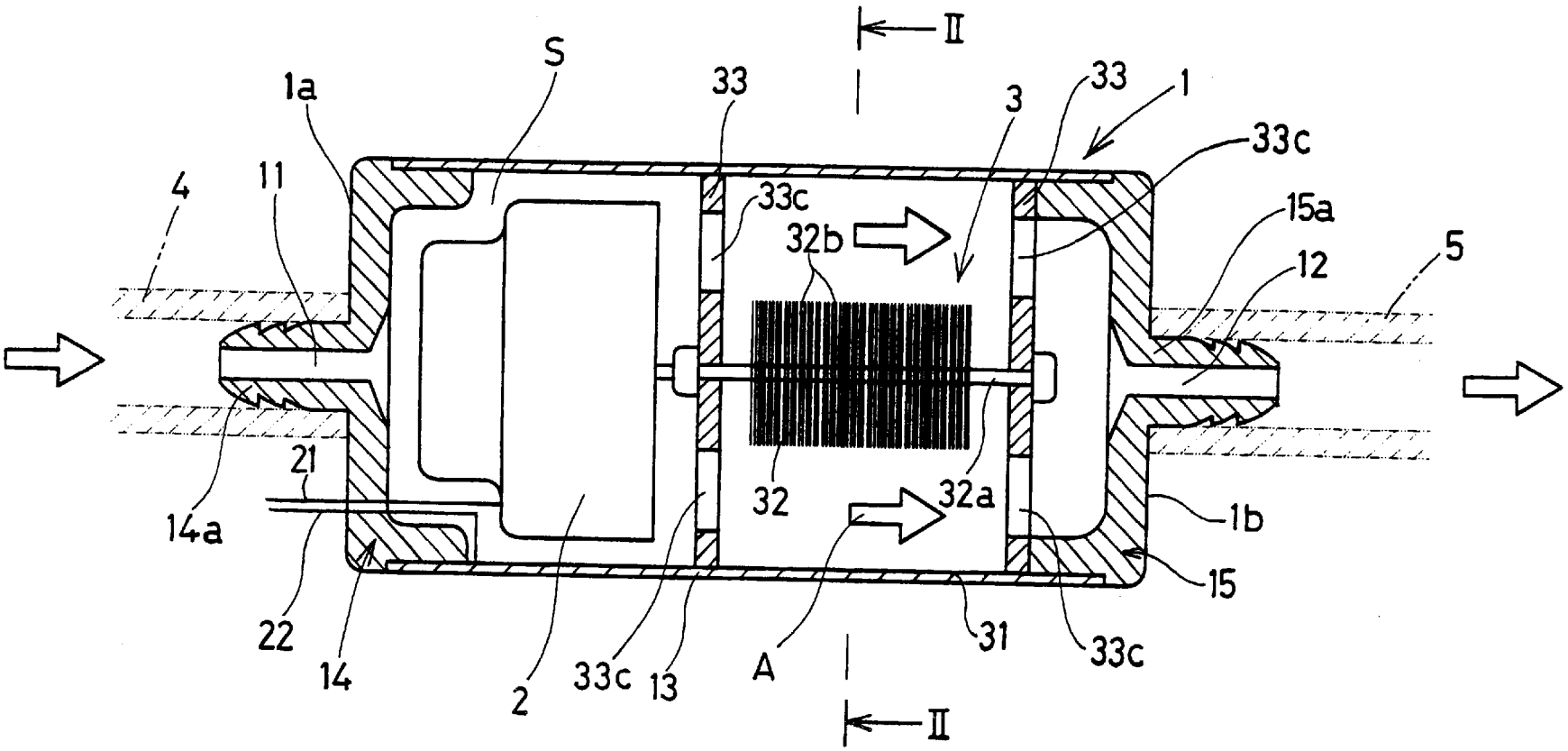
FIG. 1 is a sectional view showing an embodiment of the ion generator for the combustion apparatus in accordance with the invention.

FIG. 1 is a sectional view of an embodiment of the ion generator for use in combustion apparatuses in accordance with the invention. The ion generator comprises a cylindrical casing 1 including an intake port 11 at one end surface 1*a* thereof and an exhaust port 12 at the other end surface 1*b* thereof, the intake port 11 and the exhaust port 12 defining an air-flow passage A therebetween wherein a high-voltage generator 2 is disposed on the upstream side thereof and an ionization electrode 3 is on the downstream side thereof.

The casing 1 is formed of a cylinder body 13 with its opposite ends closed by caps 14, 15, respectively. The cap 14 at one end is formed with the intake port 11 having a connection port 14*a* for an intake pipe 4 protruded therefrom. The other cap 15 is formed with the exhaust port 12 having a connection port 15*a* for an exhaust pipe 5 protruded therefrom. The caps 14, 15 are formed of a synthetic resin material, such as polyetherimide, mixed with reinforced fiber such as a glass fiber. The intake port 11 and the exhaust port 12 are provided coaxially with the casing 1. The exhaust pipe 5 communicates with an intake manifold interposed between an air cleaner and a cylinder in the internal combustion engine as the combustion apparatus.

The high-voltage generator 2 is formed by placing components of an electric circuit for high-voltage generation in a case and then molding the components with an epoxy resin material or the like. The high-voltage generator 2 is suspended in the casing 1 by means of a plurality of ribs protruded from places on the outer periphery of the high-voltage generator. In the casing, a gap S is defined along the outer periphery of the high-voltage generator and its end surface opposite to the intake port 11 such that air drawn into the casing 1 via the intake port 11 may be allowed to flow therethrough. Further, the high-voltage generator 2 is disposed concentrically with the intake port 11 and the exhaust port 12. In the figure, the reference numeral 21 denotes a power cable whereas the numeral 22 denotes a ground lead for grounding the casing 1 to the vehicle body.

The ionization electrode 3 comprises an outside electrode 31 composed of a part of the cylinder body 13 of the casing 1, an inside electrode 32 located at the center of the outside electrode 31, and a pair of support plates 33 for supporting the inside electrode 32. The inside electrode 32 comprises a brush-type electrode including a conductive shaft 32*a* laid transversely between the pair of support plates 33, and a multitude of bristles 32*b*, such as of a thin conductive wire, attached to the periphery of the conductive shaft 32*a* as extended radially toward the outside electrode 31. The inside electrode 32 has the bristles 32*b* successively arranged for a predetermined length along the axis of the outside electrode 31, thus having a bar-like shape extending axially of the outside electrode 31. The outside electrode 31 is connected to the negative pole of the high-voltage generator 2 whereas the inside electrode 32 is connected to the positive pole thereof.

Figure 2:
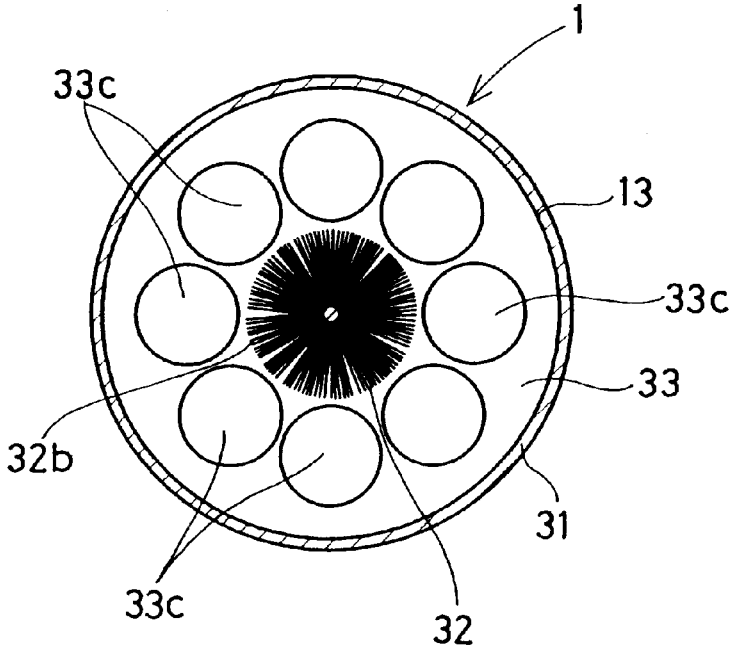
FIG. 2 is an expanded sectional view taken on line II—II of FIG. 1.

The pair of support plates 33 are each shaped like a disk formed of an insulating material and formed with vent holes 33*c* extending therethrough for allowing the air from the intake port 11 to flow through the interior of the casing 1 and to the exhaust port 12. The vent holes are disposed on a circumference of a circle about the conductive shaft 32*a* as spaced from each other at regular intervals (see FIG. 2).

With the above construction, the air can be introduced from the intake port 11 into the casing 1 by virtue of the negative pressure in the intake manifold so that the air thus introduced can be led through the gap S defined between the high-voltage generator 2 and the casing 1 to the exhaust port 12 and that the air through the gap S can be utilized for cooling the high-voltage generator 2. In addition, the air having passed by the high-voltage generator 2 may be ionized by the plasma discharge from the ionization electrode 3 before supplied to a combustion air in the intake manifold by way of the exhaust port 12 and the exhaust pipe 5. In this process, there exists no adverse possibility of the occurrence of plasma discharge in space other than that between the outside electrode 31 and the inside electrode 32 because the outside electrode 31 is set to the negative pole while the inside electrode 32 is set to the positive pole. Thus, the high-voltage generator 2 is prevented from being overheated by the additional plasma discharge. Furthermore, since the high-voltage generator 2 is located upstream of the ionization electrode 3, the high-voltage generator 2 is prevented from being affected by heat generated in association with the plasma discharge between the outside electrode 31 and the inside electrode 32. Such an effect, as combined with the positive cooling of the high-voltage generator 2, assures the prevention of overheating of the high-voltage generator 2 and hence, a considerable increase in the service life thereof results.

The inside electrode 32 comprises the brush-type electrode wherein the multiple bristles 32*b* are successively arranged along the axis of the outside electrode 31 such that the efficiency of plasma discharge between the inside electrode 32 and the outside electrode 31 may be notably increased. This provides a stable and efficient ionization of the air introduced into the casing 1 for supplying the air ionized in high concentration to the cylinder of the internal combustion engine. Consequently, the internal combustion engine can achieve an even higher combustion efficiency for an enhanced improvement of the fuel economy and reduction of the air pollution.

Further, the intake port 11, the exhaust port 12 and the high-voltage generator 2 are concentrically arranged about the axis of the casing 1 so that the whole body of the high-voltage generator 2 may be uniformly cooled by the air. This is effective to increase the service life of the high-voltage generator 2 even further.

Figure 3:
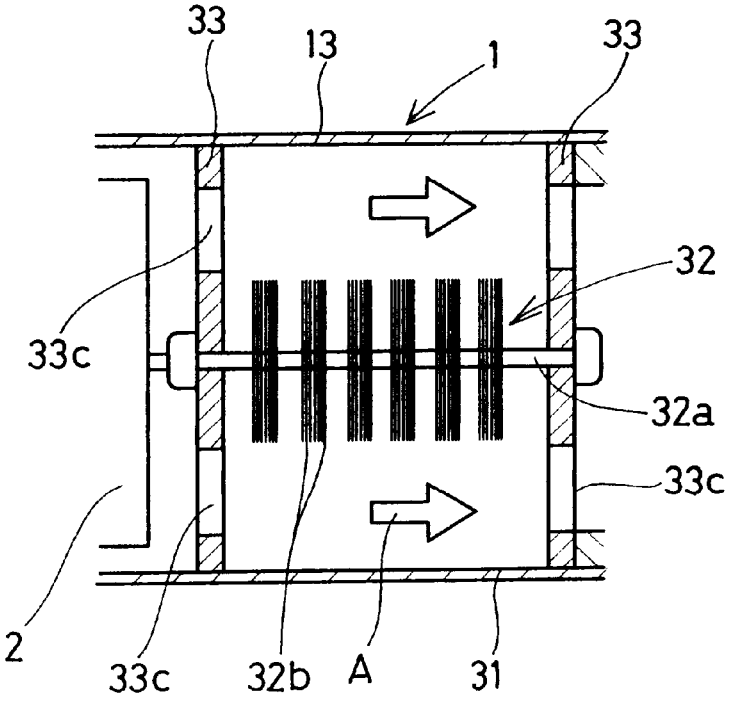
FIG. 3 is a sectional view showing another embodiment of the inside electrode hereof.
Figure 4:
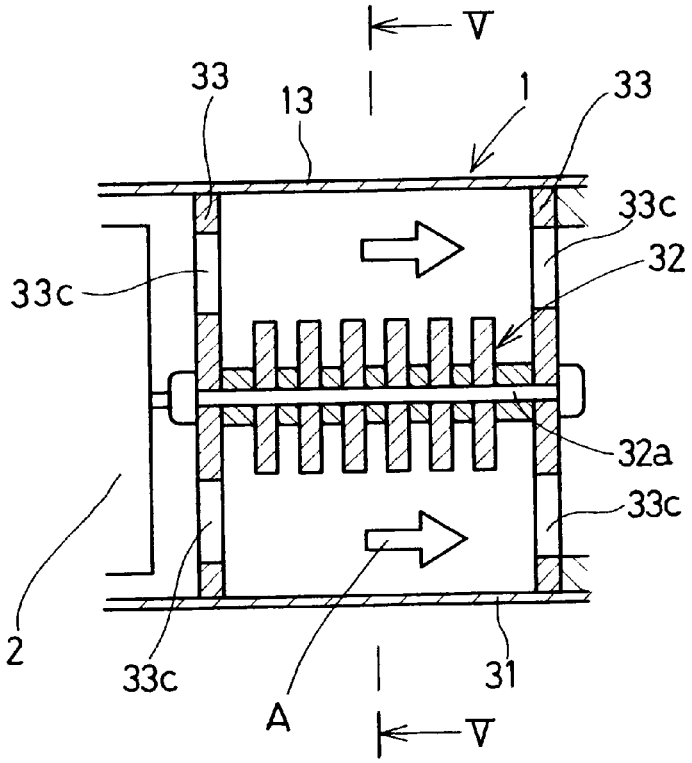
FIG. 4 is a sectional view showing still another embodiment of the inside electrode hereof.
Figure 5:
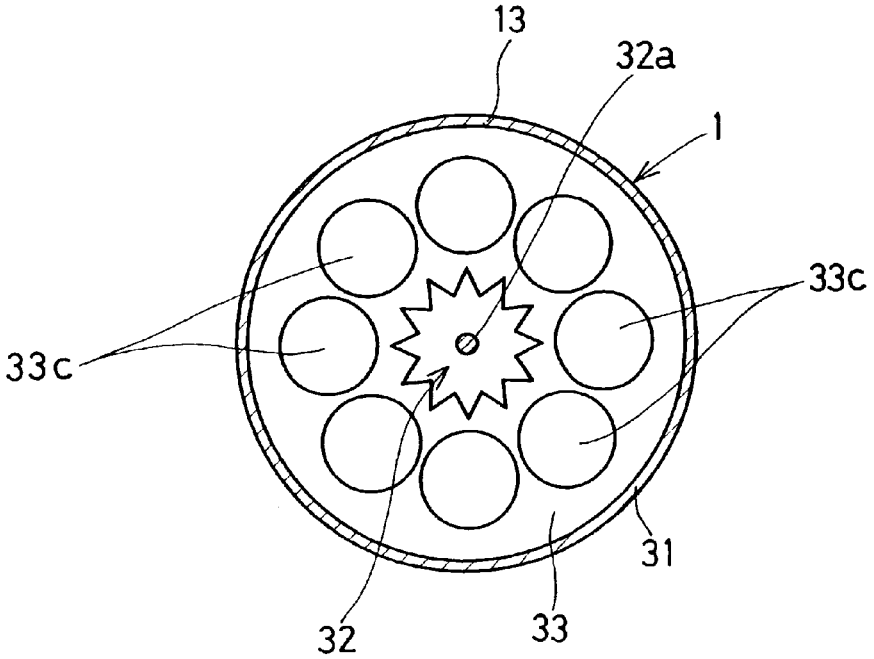
FIG. 5 is an expanded sectional view taken on line V—V of the above.
Figure 6:
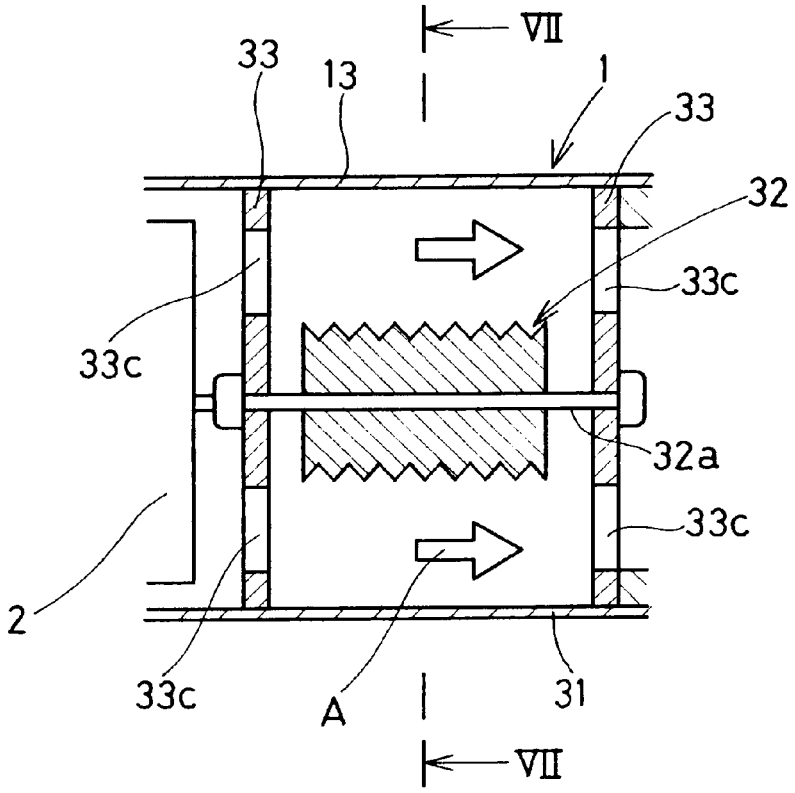
FIG. 6 is a sectional view showing yet another embodiment of the inside electrode hereof.
Figure 7:
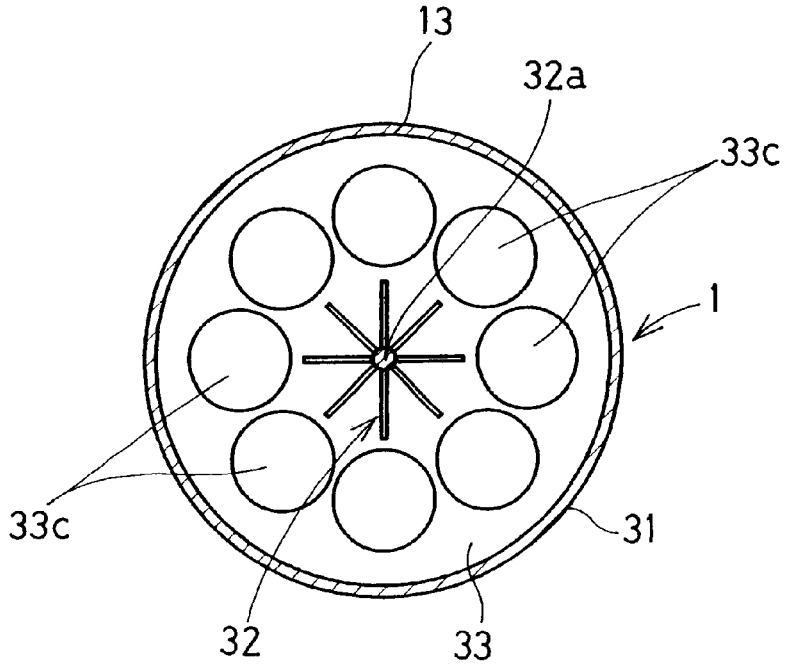
FIG. 7 is an expanded sectional view taken on line VII—VII of the above.

As shown in FIG. 3, the inside electrode 32 of the ionization electrode 3 may be composed of the bristles 32*b* arranged axially at regular intervals. Otherwise, as shown in FIGS. 4 and 5, the inside electrode may be composed of star-shaped electrodes arranged axially at regular intervals. Alternatively, as shown in FIGS. 6 and 7, the inside electrode may be composed of flat plates radially arranged, each flat plate having a zigzag edge portion at the distal end thereof.

Figure 8:
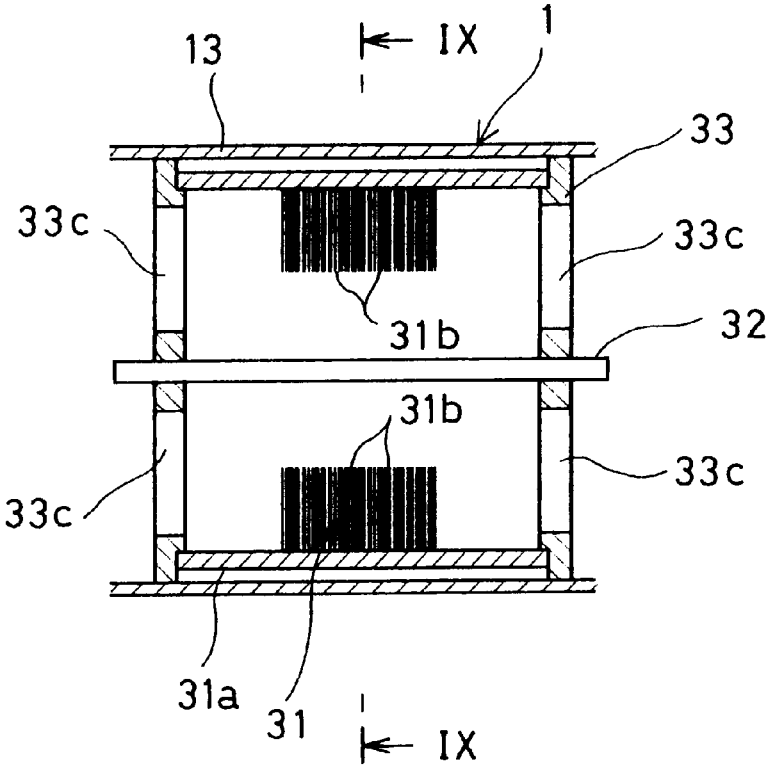
FIG. 8 is a sectional view showing another embodiment of the ionization electrode hereof.
Figure 9:
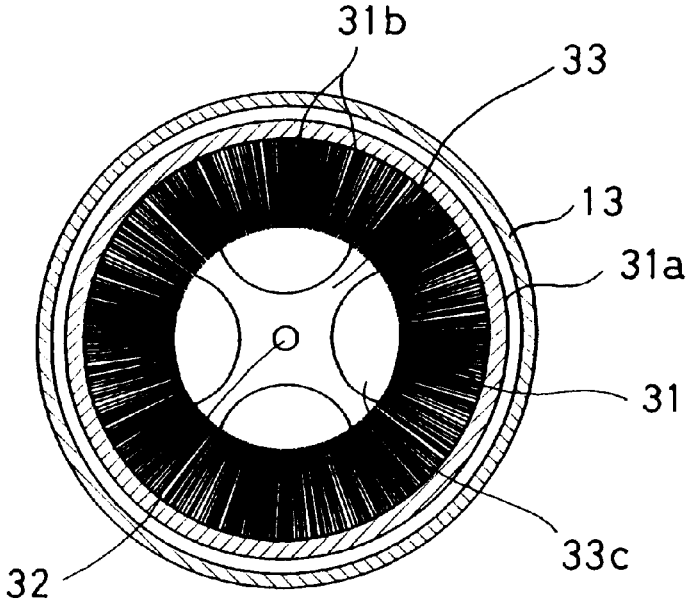
FIG. 9 is an expanded sectional view taken on line IX—IX of the above.

As shown in FIGS. 8 and 9, the ionization electrode 3 may include the inside electrode 32 composed of a bar-like body and the outside electrode 31 composed of a cylindrical brush-type electrode with a multitude of bristles 31*b* of conductive thin wire attached thereto. In this embodiment, the bristles 31*b* of the outside electrode 31 are rooted in the inner periphery of a cylinder body 31*a*, such as of a conductive metal, fitted in the inner periphery of the casing 1. Additionally, the bristles 31*b* are successively arranged for a predetermined length axially of the outside electrode 31 and oriented toward the inside electrode 32 in such a manner as to surround the inside electrode 32. This embodiment is also adapted to ionize the air introduced into the casing 1 in a stable and efficient manner for supplying the air ionized in high concentration to the cylinder of the internal combustion engine. Hence, the internal combustion engine achieves an even higher combustion efficiency for more effective improvement of the fuel economy and reduction of the air pollution.

Figure 10:
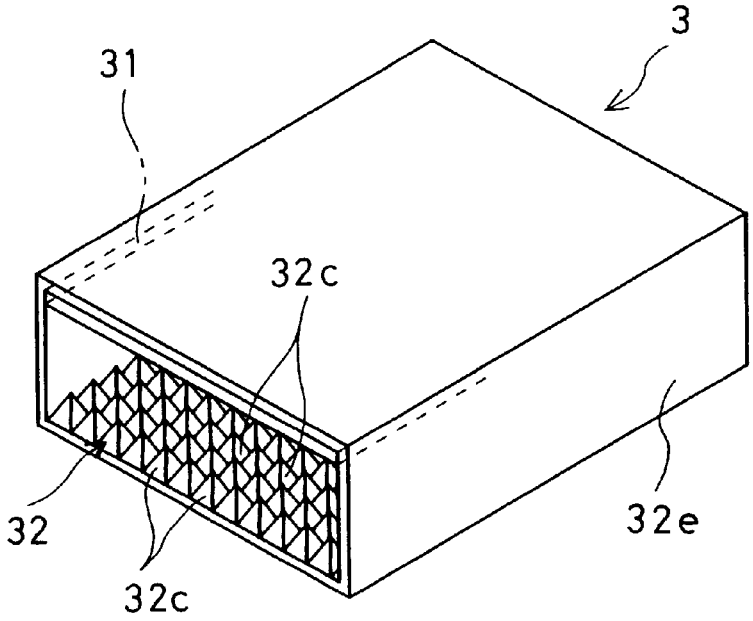
FIG. 10 is a perspective view showing still another embodiment of the ionization electrode hereof.

FIG. 10 is a perspective view showing still another embodiment of the ionization electrode 3. In the embodiment, the outside electrode 31 is composed of a flat plate such as of a conductive metal whereas the inside electrode 32 includes an array of pyramid bodies 32*c* upstood toward the outside electrode 31. These electrodes are accommodated in a square cylinder 32*e* such as of an insulating resin material, as spaced from each other by a predetermined distance. The multiple pyramid bodies 32*c* are integrally formed by pressing a conductive metal sheet, being continuous to one another. The array of pyramid bodies 32*c* opposes the overall area of the outside electrode 31. The embodiment is adapted to ionize the air introduced into the casing 1 in a more stable and efficient manner for supplying the air ionized in high concentration to the cylinder of the internal combustion engine.

Figure 11:
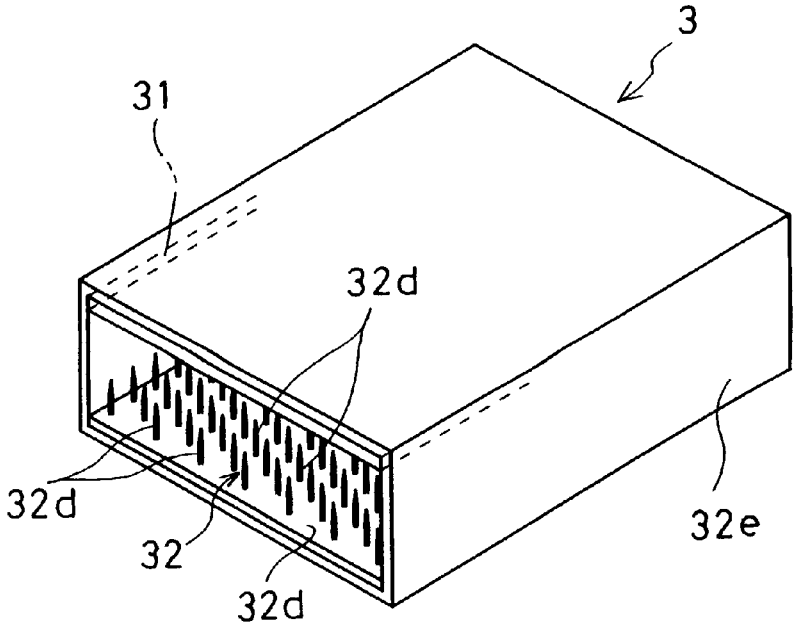
FIG. 11 is a perspective view showing yet another embodiment hereof.
Figure 12:
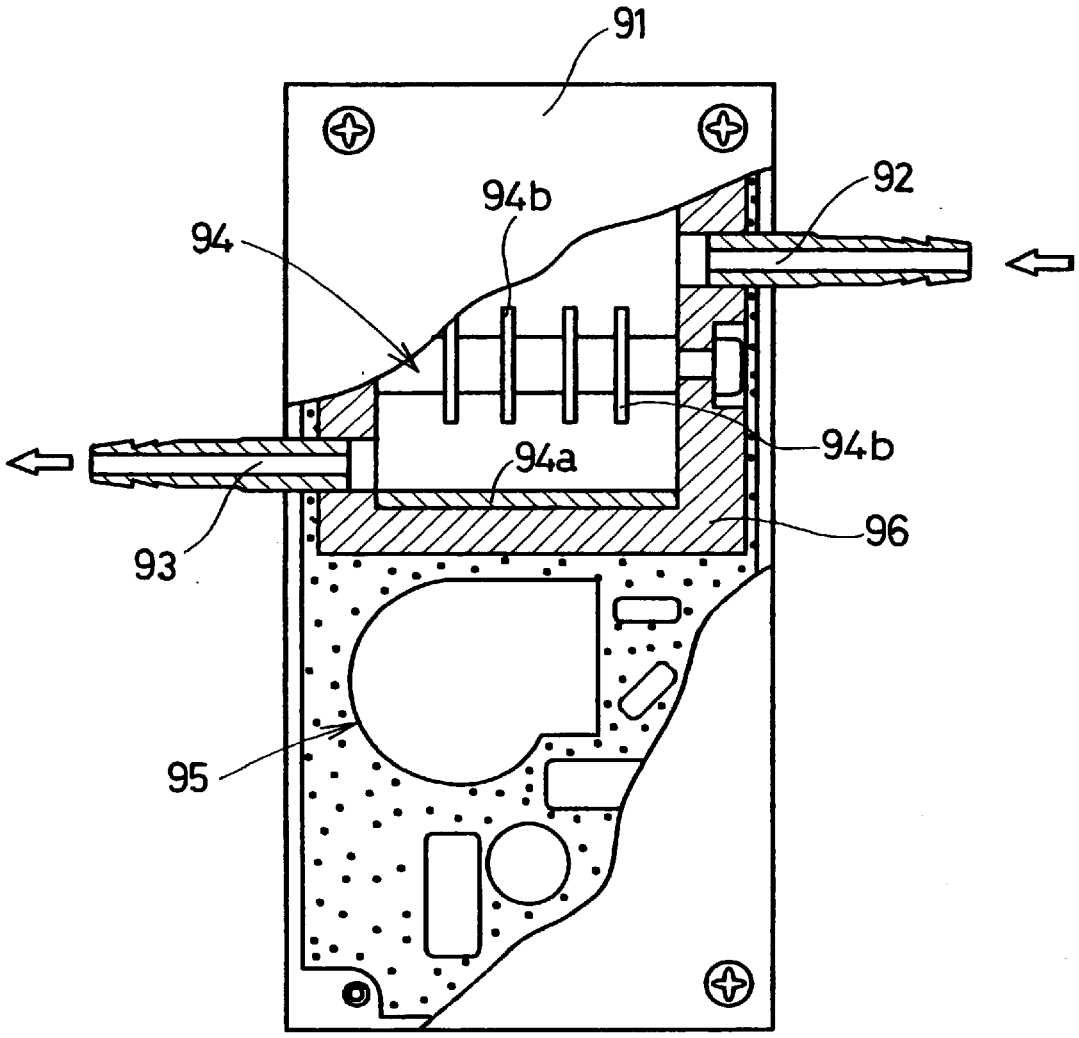
FIG. 12 PRIOR ART
FIG. 12 is a sectional view showing an example of the prior art.

In the above case where the outside electrode 31 is formed of the flat plate such as of a conductive metal, the inside electrode 32 may include an array of sharp-pointed pins 32*d*, as shown in FIG. 11. In this case, the pins 32*d* are each rooted in the conductive metal plate 32*d* so as to be conducted to one another. Incidentally, besides the pyramid bodies 32*c* and pins 32*d*, cone-like bodies or members shaped like a saw blade may be used as the sharp-pointed member for constituting the inside electrode 32.

It is to be noted that the ion generator for use in the combustion apparatuses according to the invention should not be limited to the foregoing embodiments thereof and variations thereto will occur to those skilled in the art within the scope of the invention. In the embodiments shown in FIGS. 1 to 7, for example, the outside electrode 31 of the ionization electrode 3 may be separate from the cylinder body 13 of the casing 1, the casing may be shaped like a square in section, or the like.

Additionally, the ion generator of the invention is applicable to other combustion apparatuses than the aforementioned internal combustion engines. Examples of such combustion apparatuses include boilers, heat treat furnaces, incinerators, and the like.

What is claimed is:

1. An ion generator comprising:

a cylindrical casing including an intake port at one end surface thereof, an exhaust port at the other end surface thereof and an air-flow passage defined between said intake port and said exhaust port, and grounded at a predetermined portion;

a high-voltage generator disposed on an upstream side of the air-flow passage as defining a gap for the air-flow passage between an inner periphery of said casing and an outer periphery of said high-voltage generator; and an ionization electrode including an outside electrode and an inside electrode disposed on a downstream side of the air-flow passage and spaced from each other by a predetermined distance, said inside electrode connected to a positive pole of said high-voltage generator while said outside electrode connected to a negative pole of said high-voltage generator, wherein said intake port, said exhaust port and said high-voltage generator are concentrically arranged about an axis of said casing.

2. The ion generator as set forth in claim 1, wherein said inside electrode comprises a brush-type electrode including a multitude of bristles formed of a conductive metal and extending radially toward an inner periphery of said outside electrode.

3. The ion generator as set forth in claim 2, wherein said brush-type electrode has said multitude of bristles successively arranged for a predetermined length along an axis of said inside electrode, thus forming a bar-like shape.

4. The ion generator as set forth in claim 1, wherein said outside electrode comprises a brush-type electrode in which a multitude of bristles formed of a conductive metal are so arranged as to surround a bar-shaped inside electrode, as oriented toward said inside electrode.

5. The ion generator as set forth in claim 4, wherein said brush-type electrode is shaped like a cylinder with said multitude of bristles successively arranged for a predetermined length axially of said outside electrode.

6. The ion generator as set forth in claim 1, wherein said outside electrode of said ionization electrode comprises said casing.

* * * * *